United States Patent [19]

Azalbert

[11] 4,284,241

[45] Aug. 18, 1981

[54] SPRAY NOZZLE FOR DISTRIBUTION OF LIQUID WHICH IS INTENDED TO BE AFFIXED TRANSVERSELY TO THE WALL OF A CONDUIT

[76] Inventor: Pierre Azalbert, Paulhac, 31380 Montastruc la Conseillere, France

[21] Appl. No.: 85,703

[22] Filed: Oct. 17, 1979

[30] Foreign Application Priority Data

Oct. 18, 1978 [FR] France ..... 78 30132

[51] Int. Cl.[3] ..... B05B 1/14

[52] U.S. Cl. ..... 239/272; 239/499; 239/504; 239/524

[58] Field of Search ..... 239/271, 272, 498, 499, 239/502, 504, 518, 524, 567, DIG. 1, 600

[56] References Cited

U.S. PATENT DOCUMENTS

| | | | |
|---|---|---|---|
| 2,716,574 | 8/1965 | Chase | 239/547 |
| 3,240,434 | 3/1966 | Bradley | 239/271 |
| 3,292,378 | 12/1966 | Rosenthal et al. | 239/547 X |
| 3,527,412 | 9/1970 | West | 239/499 X |

FOREIGN PATENT DOCUMENTS

| | | |
|---|---|---|
| 1387090 | 12/1964 | France . |
| 1434601 | 2/1966 | France . |
| 2181401 | 11/1973 | France . |
| 2205827 | 5/1974 | France . |
| 2185349 | 7/1974 | France . |
| 2251994 | 6/1975 | France . |
| 2338640 | 1/1976 | France . |
| 2345219 | 10/1977 | France . |

*Primary Examiner*—Andres Kashnikow

*Attorney, Agent, or Firm*—Sandler & Greenblum

[57] ABSTRACT

A spray nozzle is disclosed which can be attached transversely to a conduit wall for distributing liquid passing through the conduit. The nozzle is attached through an orifice in the wall and includes a body and a deflector attachable to each other. The body includes a bottom, a head, an axial passage, a liquid inlet adjacent the bottom and a jet adjacent the head, such that the nozzle is attached to the conduit by penetrating a nipple at the bottom of the body through the conduit wall. An inlet orifice prevents undesirably large sized objects from entering the passage. When the nozzle is inserted into the conduit an annylar groove positioned above the nozzle piercing nipple serves to securely retain the nozzle on the wall.

10 Claims, 3 Drawing Figures

SPRAY NOZZLE FOR DISTRIBUTION OF LIQUID WHICH IS INTENDED TO BE AFFIXED TRANSVERSELY TO THE WALL OF A CONDUIT

The object of the present invention is to provide a spray nozzle for distribution of liquid of the type adapted to be affixed transversely to the wall of a delivery conduit of the liquid through an orifice with which it is provided.

It is known particularly in the irrigation technology of truck farming cultivation, seed bed cultivation or other types of cultivation to regularly space spray nozzles on a conduit, which is preferably a flexible conduit, passing through the wall of said conduit. The spray nozzle is bored with an axial passage comprising a liquid inlet orifice and discharge jet and provided with a deflector device integral with the body of the spray nozzle over the jet adapted to direct the projection of the liquid radially around the spray nozzle. In most known spray nozzles, the deflector device is a hood attached by a ratchet mechanism to the body of the spray nozzle forming a chamber over the jet whose preferably cylindrical wall is provided with apertures around its periphery.

According to this known arrangement, it is necessary that the ratchet mechanism offer a sufficient resistance such that the hood is not torn away from the water pressure. This resistance which is necessary for the aforementioned reason is however troublesome considering the small dimensions of the spray nozzle and its hood when, for example, it must be removed as will be explained below in more detail to clear the passage through its jet.

In most known spray nozzles, in order to increase the discharge pressure of the liquid and to regulate the flow, the passage is provided with a constriction at the level of its jet which is of small cross section or diameter on the order of one millimeter or less and of a smaller value than the diameter of the passage and particularly of its inlet orifice.

The result of this arrangement of known spray nozzles is that when the liquid contains impurities or when it passes instead a charged liquid the impurities or undissolved particles of the charge penetrate into the passage and block the jet which renders the spray nozzle inoperative. The difficulty encountered in removing the hood on account of the necessary resistance of the ratchet mechanism because of the pressure of the liquid as well as the small diameter of the jet renders the clearance impossible without disassembly of the spray nozzle. Even after disassembly it is very difficult act through the inlet orifice to clear the jet, which is most cases requires recourse to a pressurized fluid such as compressed air. This inconvenience obligates the user to constantly survey the spraying ramps thus constituted and it requires replacement spray nozzles which is costly. Furthermore, when the spray nozzles must be replaced there is the inconvenience of damage to the wall of the flexible conduit. In order to avoid this some known spray nozzles have their bottom part which penetrates into the conduit made out of a tube with threading. However, this known arrangement does not provide greater satisfaction, because considering the necessarily reduced dimensions of the spray nozzle and of its base which penetrates into the conduit the threading which is provided thereon is too small to assure a truly efficient attachment. Furthermore, the cooperation of a small thread of hard material with a flexible wall cannot be truly efficient and causes a risk of rapid deterioration of the lips of the orifice provided in the wall for the passage of the base of the spray nozzle.

The invention aims to overcome these inconveniences by providing a spray nozzle of the aforementioned type whose design on the one hand reduces to a minimum the risk of blockage by the impurities contained in the fluid and, on the other hand, where blockage occurs, facilitates clearing in the field. The invention aims to realize a spray nozzle provided with efficient means of attachment on the flexible conduit. To accomplish this the liquid distribution spray nozzle according to the invention is adapted to be affixed on and through the wall, through an orifice with which it is provided, with a liquid delivery conduit fed from the system or from a pumping station. The spray nozzle comprises a body bored with an axial passage with a liquid inlet at the end of a bottom part penetrating into the conduit provided with blocking means and with a jet at the top of said body with a deflector device rising above. The cross section or diameter of the inlet orifice is smaller than the cross section or diameter of the passage and/or of the jet.

The passage is preferably flared from the inlet orifice to the jet and has the form of a reversed frustoconical section such that the impurities which would have been able to penetrate therein through the small inlet orifice flattened out in relation to the passage and the jet cannot be blocked against its flared walls and are evacuated to the outside by the pressure of the water. According to another arrangement of the spray nozzle according to the invention the deflector is a removable hood on the head of the body having a hollow cylindrical part blocked at one end at a greater height than that of the head in order to provide a chamber whose wall is provided on its periphery with apertures for radial dispersion of the liquid. The head of the body and the inside wall of the hood are provided with small threads permitting the attachment of one on the other by screwing. This arrangement of the invention facilitates the assembly and disassembly of the deflector hood and further comprises means for gripping the hood which are preferably comprising regularly spaced vertical small bars or ribs provided on the exterior cylindrical surface of the hood.

According to another arrangement of the invention the element penetrating into the conduit is an inverted frustoconical nipple whose tip or small section is pierced by the liquid inlet orifice which causes said nipple to act as a deflector.

Other advantages and characteristics of the invention will appear from the description hereinafter of one preferred embodiment of the invention given as nonlimiting example and illustrated by the attached drawings wherein.

Figure 1:
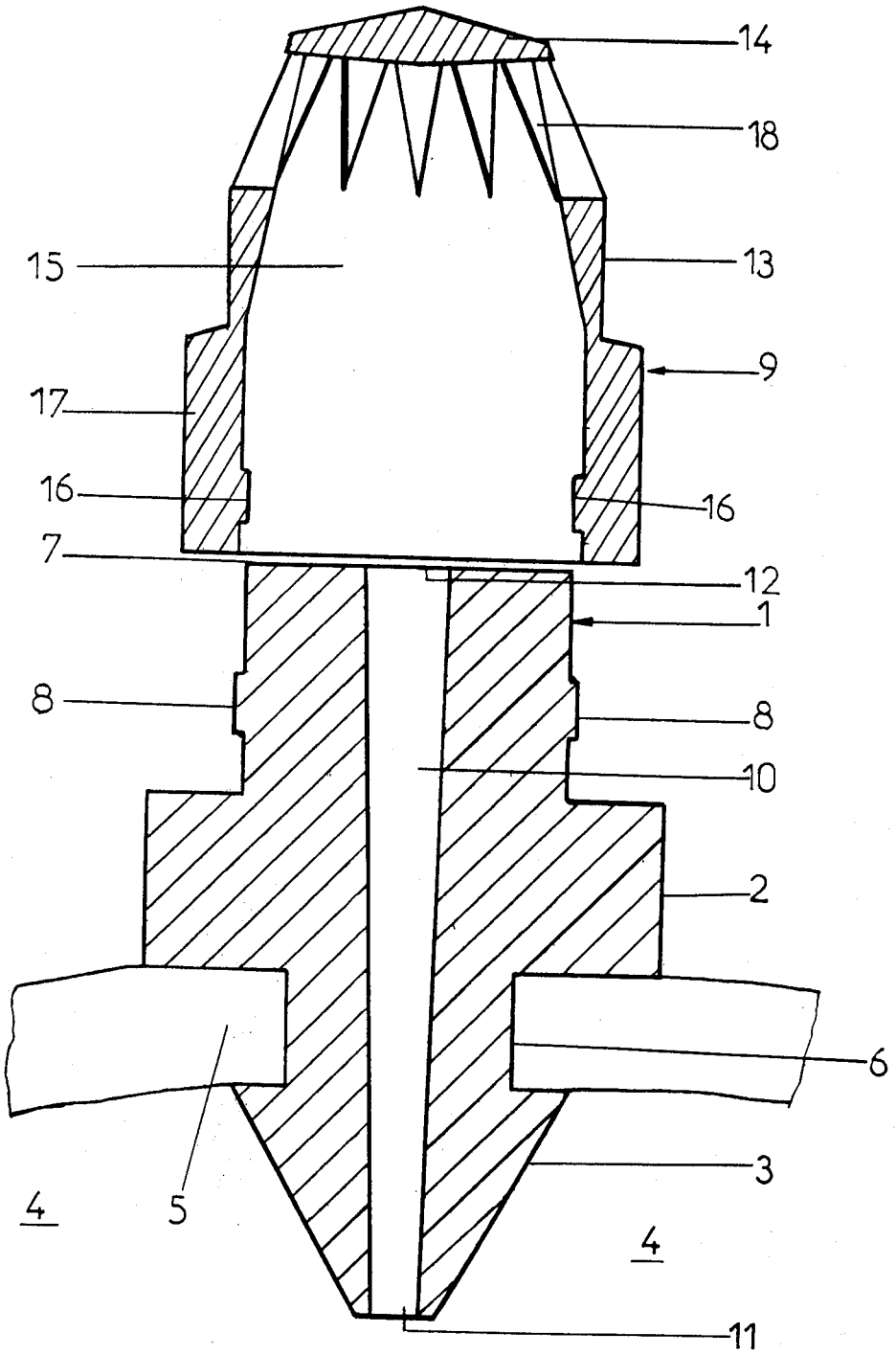
FIG. 1 represents a cross sectional view of a conduit equipped with the spray nozzle according to the invention also seen in cross section.
Figure 2:
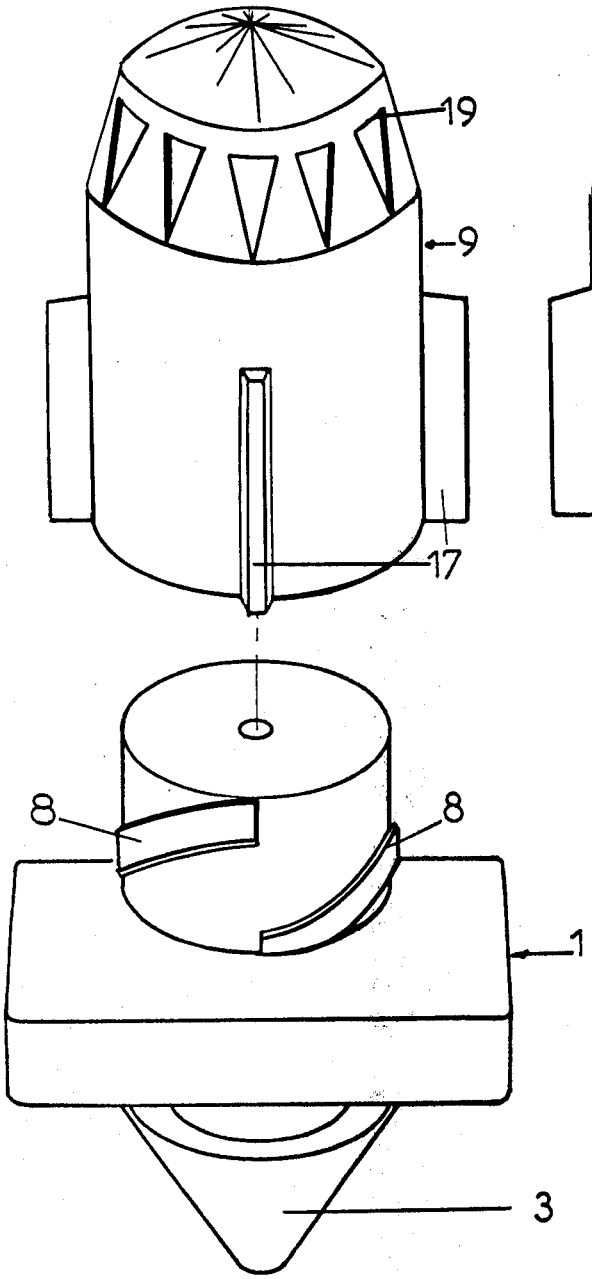
FIG. 2 represents an elevational view of the spray nozzle according to the invention with its hood.
Figure 3:
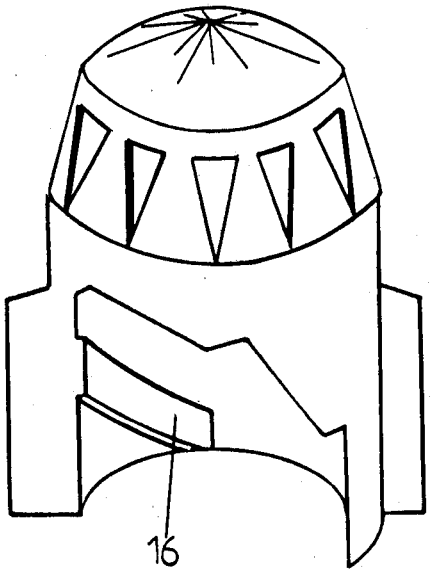
FIG. 3 represents the deflector hood.

As shown the spray nozzle according to the invention comprises a cast body made of a hard synthetic material. The body constituting the spray nozzles comprises a head 1, a horizontal wall 2 forming shoulder perpendicular to the axis and a part or piece below said horizontal wall penetrating into the conduit. The bottom piece is a nipple 3 in the form of a truncated cone oriented toward the median axis of the conduit 4 into which it penetrates by being driven in through an orifice realized in any known manner for example by boring or by means of a punch through wall 5. The conicity of nipple 3 is very pronounced, actually on the order of 30 to 35 degrees, such that upon being driven in it spaces the wall of the flexible conduit.

At the base of the frustoconical nipple 3 between said nipple and the horizontal wall 2 is provided an annular groove 6 by constriction of the base of said nipple 3 in which the flexible wall 4 of the tube will come to be blocked which contributes to an efficient attachment of the spray nozzle since after parting by the nipple the wall will be constricted over the nozzle in the groove.

The height of the groove is limited by the perpendicular wall 2 provided by the casting over said groove. The wall 2 comprises a shoulder which limits the driving in of the spray nozzle in the tube and it contributes to the sealing of the attachment of the spray nozzle on the wall of the flexible conduit under the effect of the pressure. It is self evident that the height of the annular groove 6 and thus also to a certain extent its depth are a function of the thickness of the wall of the flexible conduit. Wall 2 has an essentially square shape which facilitates the gripping of the spray nozzle and its insertion and whose side has a greater dimension than the cross section of the nipple 3 and of the head 1. Head 1 provided during casting on wall 2 has a frustoconical shape having an upper horizontal cross section 7. On its cylindrical surface are provided small threads 8 in relief or as male threads. Still threads 8 are preferably two in number and symmetrical in relation to the axis of the head. To facilitate disassembly, these small threads are of small thickness and of greater width than their thickness, wherein said width can be on the order of approximately one millimeter and their thickness on the order of approximately 1/10th millimeter. On the head thus constituted is screwed a deflector hood 9 which will be described below.

In the body as described is provided a passage 10 along the median longitudinal axis provided with an inlet orifice 11 of the liquid in the middle of the small cross section of the end of the frustoconical nipple 3 and with a jet 12 for liquid discharge in the middle of the section 7 of cylindrical head 1.

According to one particular characteristic of the invention the inlet orifice 11 has a cross section or a diameter smaller than that of the passage and particularly of the jet 12.

The passage is preferably flared from said orifice 11 to the jet 12, this flaring giving it the form of a downwardly directed truncated cone. This arrangement of the invention makes possible in the case wherein an impurity contained in the liquid would penetrate into conduit 10 to avoid that be retained by the wall of the conduit but on the contrary it would be evacuated under the effect of the pressure since in order to penetrate into the conduit this impurity will necessarily have dimensions corresponding to the smallest diameter of the conduit at the level of inlet orifice 11. The size of the inlet must be smaller to prevent blockage of the nozzle as explained hereinafter.

In the case wherein the impurity would have a greater cross section it could not penetrate into the passage and it would at most be blocked by the pressure against the inlet orifice 11. It must also be noted that the frustoconical shape of nipple 3 confers on this member a deflector function for the impurities carried by the liquid and that the reduced cross section of said frustoconical deflector at its end on when the orifice is provided prevents the blocking of the impurities at this point of the spray nozzle because of the circulation of the fluid. It is also possible without going beyond the scope of the invention to design the passage as cylindrical and that a flattening out decreasing the diameter of the passage be provided at the level of the inlet orifice which determines the flow of the spray nozzle. The diameter of the passage and of the inlet orifice is a function of the desired flow. As an example for the spray nozzles adapted for sprinkling installations the diameters are 850 microns at the inlet orifice and 870 microns at the jet thus having a slight conicity. It is established that by this arrangement of the invention the blockage of the passage is practically impossible.

Also in the case wherein by accident a blockage would be produced it is easy to remedy it since the smooth wall of the flared passage cannot form any obstacle to the evacuation of the impurities for example under the thrust of a mandrel of suitable dimension.

As has been disclosed above, a deflector device 9 is mounted on cylindrical head 1. The deflector device is a hood of hollowed out cylindrical form and whose cylindrical wall 13 is blocked at one of its ends by a transverse wall 14. The height of the cylindrical wall of the hood is greater than that of head 1 over wall 2 such that a chamber 15 in which the liquid shoots forth through jet 12 is provided over the jet, when said hood is mounted on said head and comes into engagement on wall 2. The liquid is deflected by contact with wall 14 of which the inside surface is preferably bulged out toward its center. On the inside surface of the cylindrical wall of the deflector hood are provided small threads 16 in relief whose orientation, pitch and dimensions correspond to those of small threads 8 provided on the cylindrical surface of the head such that the hood is attached by screwing on said head. Preferably small threads 16 are small threads in relief or male threads, as are small threads 8 under which they are positioned. In order to facilitate the screwing on, the external cylindrical surface of the deflector hood is provided with gripping means comprising regularly spaced vertical ribs or small bars 17. In the vicinity of wall 14 on the periphery of the cylindrical part of the hood is provided a plurality of successive apertures of openings 18 through which the liquid will be sprayed. These apertures which can be provided as shown on an annular surface which is inclined upward and toward the median axis of the hood at the tip of its cylindrical wall are realized by casting in succession with a pitch near to or smaller than their width.

According to another characteristic of the invention the apertures are narrower at the base than at the top, as bottom and top are understood when the hood is in position. For this reason the apertures have an inverted triangle shape with the tip at the bottom whose base 19 is parallel to the top edge of the hood and whose tip is directed toward the bottom of the hood. This arrangement of the invention leads to a better dispersion of the liquid by a better distribution of the liquid. Particularly, this arrangement of the invention permits radial diffusion of the liquid in a homogenous manner over the entire radius. The inventive device furthermore makes it particularly possible to avoid that the liquid be more diffused in the vicinity of the spray nozzle than at the end of the diffusion radius since the end of the diffusion radius is sprayed by the liquid escaping through the larger top part of the aperture while the immediate peripheral area surrounding the spray nozzle is sprayed through the bottom of the aperture whose flow is weaker.

The device according to the invention is applicable for any installation for the distribution of liquid by spraying and particularly in the domain of irrigation of growing things.

The device according to the invention can receive fittings and variations within the domain of technical equivalents without thereby exceeding the scope of the present patent.

I claim:

1. A spray nozzle for distributing a liquid, said nozzle adapted to be attached to a wall of a liquid delivery conduit of a liquid delivery station or pumping station through a orifice in said wall, said nozzle adapted to expand and deflect said liquid and comprising:

(a) a body having a bottom and a head, a liquid inlet orifice adjacent to said bottom, said orifice adapted to penetrate said conduit, a jet adjacent to said head and a generally conical axial passage gradually flared outwardly in a direction from said orifice to said jet, said passage having the shape of an inverted truncated cone having said orifice at its peak, said orifice having a diameter adapted to prevent undesirable objects from entering said passage; and (b) a deflector comprising a generally hollow and cylindrical hood adapted to be detachably and securely connected to said body to form a chamber and thereby permit expansion of said liquid therein, said hood blocked at one end thereof and comprising at least one aperture, said hood adapted to deflect liquid radially outwardly from said chamber through said aperture, said hood further including an inner surface with threads and said body having a cylindrical outer surface with complimentary threads so that said hood can be screwed onto said body.

2. A spray nozzle in accordance with claim 1 wherein said bottom adapted to be inserted into said conduit is a nipple having the shape of an inverted truncated cone having said orifice adjacent its peak and a blocking groove adjacent its base, said groove adapted to receive lips of the conduit wall where the bottom is inserted.

3. A spray nozzle in accordance with claim 2 wherein said body further comprises a wall between said groove and said head positioned transverse to the longitudinal axis of said body, said wall being generally square and forming a shoulder for limiting penetration of the nipple into the conduit when inserted and for facilitating gripping of said nozzle.

4. A spray nozzle in accordance with claim 1 wherein said threads are in pairs located symetrically about the longitudinal axis of the body.

5. A spray nozzle in accordance with claim 1 wherein the hood further comprises an outer wall having at least one vertical projection parallel to the longitudinal axis of said body, said projection adapted to facilitate the gripping and screwing of said hood.

6. A spray nozzle in accordance with claim 1 comprising a plurality of said apertures through which liquid is deflected.

7. A spray nozzle in accordance with claim 6 wherein said apertures are narrower at their bottoms than at their tops, said tops being adjacent said one end.

8. A spray nozzle in accordance with either claim 6 or 7 wherein said hood is blocked by a transverse blocking wall.

9. A spray nozzle in accordance with claim 8 wherein said blocking wall includes an outwardly bulged central area.

10. A spray nozzle in accordance with claim 7 wherein said apertures are in the shape of inverted triangles having tips oriented downwardly.

* * * * *

UNITED STATES PATENT AND TRADEMARK OFFICE

CERTIFICATE OF CORRECTION

PATENT NO. : 4,284,241

DATED : August 18, 1981

INVENTOR(S) : Pierre AZALBERT

It is certified that error appears in the above—identified patent and that said Letters Patent is hereby corrected as shown below:

In the Abstract, line 12, "annylar" should be --annular--.

Column 4, line 3, "when" should be --which--; and line 47, "of" (second occurrence) should be --or--.

Signed and Sealed this

*Second* Day of *February 1982*

[SEAL]

*Attest:*

GERALD J. MOSSINGHOFF

*Attesting Officer*

*Commissioner of Patents and Trademarks*